US009084326B2

(12) United States Patent
Guan et al.

(10) Patent No.: US 9,084,326 B2
(45) Date of Patent: Jul. 14, 2015

(54) METHOD AND APPARATUS FOR LED FORWARD VOLTAGE MEASUREMENT FOR OPTIMUM SYSTEM EFFICIENCY

(75) Inventors: Hua Guan, San Diego, CA (US); Sandeep Chaman Dhar, San Diego, CA (US); Chunlei Shi, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 278 days.

(21) Appl. No.: 13/613,591

(22) Filed: Sep. 13, 2012

(65) Prior Publication Data

US 2014/0070718 A1 Mar. 13, 2014

(51) Int. Cl.
*H05B 37/02* (2006.01)
*H05B 33/08* (2006.01)

(52) U.S. Cl.
CPC ..... *H05B 33/0848* (2013.01); *H05B 33/0827* (2013.01)

(58) Field of Classification Search
USPC ..... 315/112, 113, 117, 118, 297, 307–309
See application file for complete search history.

(56) References Cited

U.S. PATENT DOCUMENTS 6,836,157 B2 12/2004 Rader et al.
7,499,007 B2 3/2009 Evans et al.
7,899,098 B2 * 3/2011 Robinson et al. ..... 372/38.02
7,903,058 B1 3/2011 Jacquet et al.
7,999,492 B2 8/2011 Emek et al.
8,049,439 B2 11/2011 Zhao et al.
8,269,430 B2 * 9/2012 Nakai ..... 315/307
2002/0047642 A1 4/2002 Miyagawa
2007/0296353 A1 12/2007 Ito et al.

FOREIGN PATENT DOCUMENTS

JP 2006254641 A 9/2006
JP 2007242886 A 9/2007

OTHER PUBLICATIONS

International Search Report and Written Opinion—PCT/US2013/059804—ISA/EPO—Jun. 11, 2014.

* cited by examiner

*Primary Examiner* — Douglas W Owens
*Assistant Examiner* — James H Cho
(74) *Attorney, Agent, or Firm* — James Gutierrez

(57) ABSTRACT

A method and apparatus for optimizing a light emitting diode (LED) operation range is provided. The method comprises the steps of: turning on at least one LED; and then measuring an anode voltage of the at least one LED; then measuring a cathode voltage of the at least one LED. Once the measurements are completed, a forward voltage of the at least one LED is calculated. After the calculation, the at least one LED is turned off and a power multiplexer switch threshold is set for that LED based on the measured anode and cathode voltages.

21 Claims, 2 Drawing Sheets

METHOD AND APPARATUS FOR LED FORWARD VOLTAGE MEASUREMENT FOR OPTIMUM SYSTEM EFFICIENCY

BACKGROUND

1. Field

The present disclosure relates generally to communication systems, and more particularly, to light emitting diodes (LEDs) forward voltage measurement for optimum system efficiency.

2. Background

LEDs are used as status indicators and displays on a wide variety of equipment and installations because of their low energy consumption, low maintenance and small size. LEDs are used in large-area displays in stadiums, as decorative displays, in traffic lights, and at airports and and railway stations for destination displays. LEDs may also be used in portable devices such as mobile phones.

The current and voltage characteristics of LEDs are similar to other diodes, in that the current depends exponentially on the voltage. This means that a small change in voltage may cause a large change in current. As a result, LEDs are not controlled by voltage alone and need a constant current source or a current limiter in series with the supply. If the supply voltage is not sufficient for the current source and the forward voltage of the LED, there is a significant current roll-off in the LEDs which is not desirable from a user's point of view. The measurement of the forward voltage of the LED can be used to prevent this current roll off. This measurement should be coupled with a system power converter that provides optimum supply voltage while maintaining the desired performance from the LED.

As cell phones and other personal devices gain more functionality more LEDs are used to indicate the status of functions and other operations. One aspect of LEDs is that the amount of voltage needed for optimum system efficiency changes over time. Another aspect particular indicator LEDs is that the forward voltage shows significant variation from part to part. In every LED driver, headroom is needed to avoid current roll-off. When the battery voltage drops, the power source may be switched to a higher boost power supply. In order to achieve the greatest system power efficiency, the threshold needs to be set as low as possible while still meeting the necessary headroom limits.

There is a need in the art for adaptively achieving the lowest headroom necessary while still providing desired current to the LEDs. The adaptive methodology provided accounts for any variation in the LED forward voltage due to process, temperature, aging, and other factors of usage in the given application

SUMMARY

Embodiments disclosed herein provide a method for optimizing a light emitting diode (LED) operation range. The method comprises the steps of: turning on at least one LED; and measuring an anode voltage of the at least one LED; and measuring a cathode voltage of the at least one LED. Once the measurements are completed, a forward voltage of the at least one LED is calculated. After the calculation, the at least one LED is turned off and a voltage multiplexer switch threshold is set for that LED based on the measured anode and cathode voltages.

A further embodiment provides an apparatus for optimizing an LED. The apparatus includes an LED, but may include more than one LED, a voltage multiplexer, a pulse-width modulator; a multiplexer; an analog to digital converter; and a processor.

A still further embodiment provides an apparatus for optimizing LED. The apparatus comprises: means for turning on at least one LED; means for measuring an anode voltage of the at least one LED; means for measuring a cathode voltage of the at least one LED; means for calculating a forward voltage of the at least one LED; means for turning off the at least one LED; and means for setting a power multiplier multiplexer switch threshold based on the measured anode and cathode voltages.

Yet a further embodiment provides a non-transitory computer readable medium. The non-transitory computer readable medium contains instructions that when executed, cause a processor to perform the steps of: turning on at least one LED; measuring an anode voltage of the at least one LED; measuring a cathode voltage of the at least one LED; calculating a forward voltage of the at least one LED; turning off the at least one LED; and setting a power multiplexer switch threshold based on the measured anode and cathode voltages.

DETAILED DESCRIPTION

Figure 1:
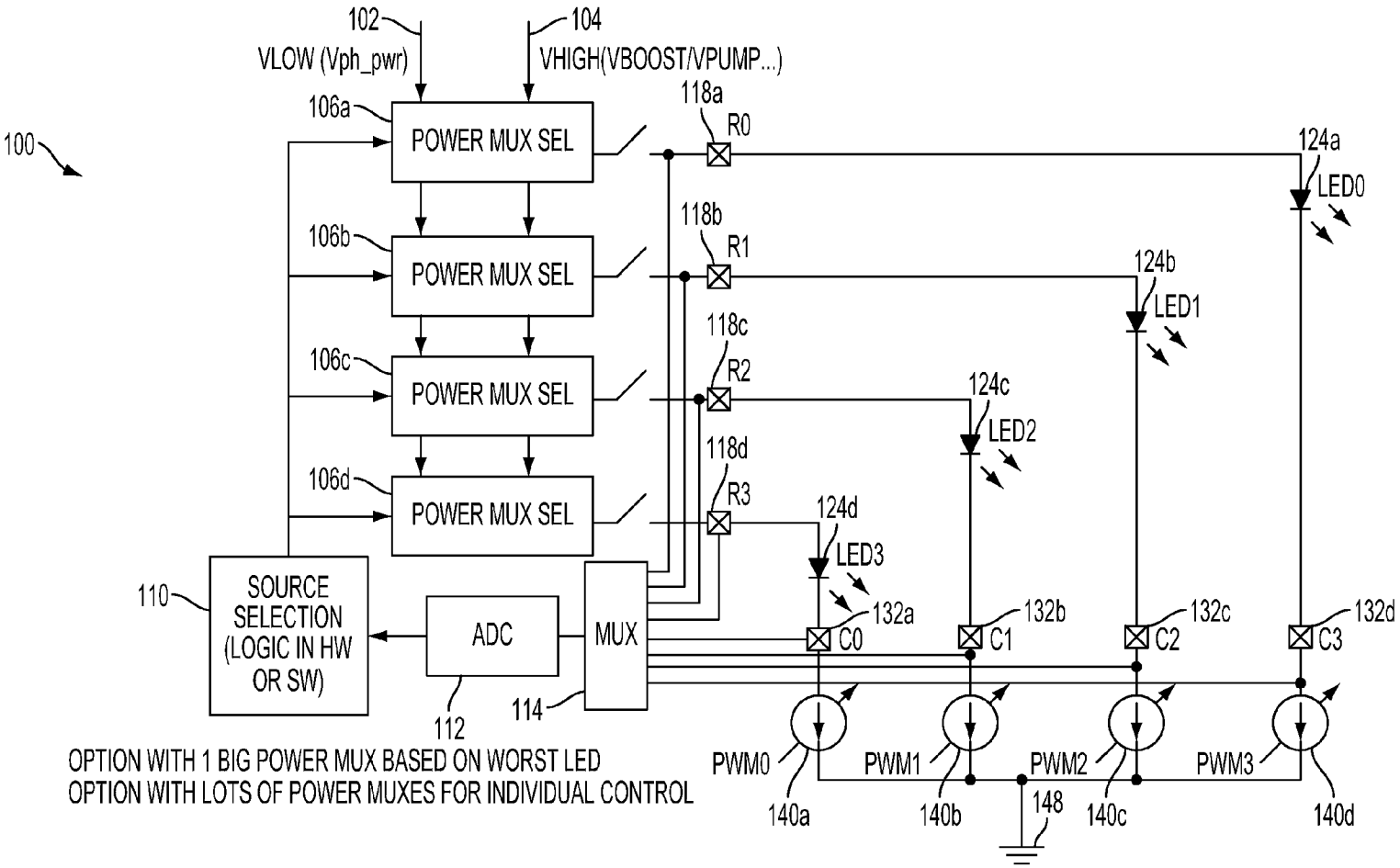
FIG. 1 illustrates an apparatus for LED forward voltage measurement for optimum system efficiency according to an embodiment.

Various aspects are now described with reference to the drawings. In the following description, for purposes of explanation, numerous specific details are set forth in order to provide a thorough understanding of one or more aspects. It may be evident, however, that such aspect(s) may be practiced without these specific details.

As used in this application, the terms "component," "module," "system" and the like are intended to include a computer-related entity, such as, but not limited to hardware, firmware, a combination of hardware and software, software, or software in execution. For example, a component may be, but is not limited to being, a process running on a processor, a processor, an object, an executable, a thread of execution, a program and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets, such as data from one component interacting with another component in a local system, distributed system, and/or across a network such as the Internet with other systems by way of the signal.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an"

as used in this application and the appended claims should generally be construed to mean "one or more" unless specified otherwise or clear from the context to be directed to a singular form.

LEDs may be used to indicate a variety of information related to the wireless system described above. Embodiments described herein provide methods and apparatus for LED forward voltage measurement for optimum system efficiency.

The embodiments described measure LED forward dropout voltage for each LED. The dropout voltage is the voltage below which the LED turns off. It is desirable to operate the LED as closely as possible to the dropout voltage because a lower voltage results in lower power consumption and extends battery life. In any LED driver, necessary headroom is required in order to avoid current roll off. When battery voltage drops, the power source must be switched to a higher voltage supply. In order to achieve the greatest system power efficiency, the threshold should be set to minimum headroom. However, the minimum headroom is not one target value, rather, minimum headroom ranges typically from 2.7 volts to approximately 3.4 volts for white LEDs at the same current as used in mobile phones The embodiments described herein make system measurements of the LEDs forward voltage and use the measurements adaptive to the LEDs in the system. In addition, the embodiments also track the change in forward voltage for the LEDs as that voltage changes with aging and temperature. The embodiments provide significant improvements in efficiency over the voltage window. As one example, LED forward voltage distribution as characterized by the LED vendor, has a variation of +/−0.2 volts with a mean voltage of 3.2V. Assume that the headroom needed for the current driver is 250 mV. To account of this variation a system has to switch its power source to boost power at the sum of the LED forward voltage and the current driver headroom, or 3.45V. Further assume that the battery voltage is at 3.3V. Hence the system will make the switch to the boost power source. However, if the LEDs that are used are measured to have a forward voltage of 3V, the embodiment described herein will not switch to the boost power source until the battery voltage is below 3.25V. This aspect is significant for system efficiency, since the efficiency under boost operation will be much lower than running directly from the battery. Assuming 85% efficiency for the boost power source and 3.3V for the battery, system efficiency for the embodiment described herein is 3/3.3=91%, while the value based on boost is 0.85*3/5=51%.

An embodiment provides that instead of selecting the LED power source based on the worst case information described on data sheets for the LEDs, the LED forward dropout voltage is measured during the power on operations of the mobile device. Each LED power source is then selected for best efficiency.

In an embodiment, the LED forward voltage is measured and when $V_{src}<V_{LED\ max}+V_{Headroom}$, the system switches from battery to boost power supplies for the LEDs. Each LED has it's own forward dropout voltage. In the embodiment, the system measures the LED's forward voltage and provides an adaptive power source switching threshold. This adaptive power threshold adapts to the LEDs in the system and also tracks forward voltage change due to aging and temperature. This feature allows the system to switch power sources at the lowest voltage that still meets the headroom requirements for accuracy. Tracking LED aging prevents current from rolling off over time as the LED forward voltage drops.

FIG. 1 illustrates the components of an apparatus for LED forward voltage measurement for optimum system efficiency. The assembly, 100 provides for a $V_{low}$ ($V_{ph_pwr}$) input 102 to a power multiplexer select 106*a*. A $V_{high}$ ($V_{boost/pump}$) input 104 is also input to power multiplexer select 106*a*. Similarly, power multiplexers 106*b-d* receive $V_{low}$ ($V_{ph_pwr}$) input 102 and $V_{high}$ ($V_{boost/pump}$) input 104. There is a power multiplexer 106 for each LED 124*a-d*. A source selection 110 is also provided and may be logic in either hardware or software. Each power multiplexer select 106*a-d* is connected through a switch to a pin 118*a-d*.

In operation, multiplexer 114 selects and reads the different voltage levels from each LED 124*a-d*. Internal analog multiplexers connect the LED anode and cathode to the on-chip ADC typically found in a highly integrated power management integrated circuit (PMIC). This voltage is just above the forward dropout voltage threshold. This occurs each time the phone is powered up, or may be measured once during manufacture at room temperature. For the latter approach, the resulting threshold may be stored in a one-time programmable memory. An advantage of this approach is low overhead, as the infrastructure in the PMIC is leveraged.

The LED forward voltage measurement and threshold adjustment described above is made through a closed loop circuit which makes the threshold adaptive to the individual LEDs on the device. This is in contrast to the maximum forward voltage in an open loop circuit.

A further embodiment provides for the LED forward voltage measurement to be increased as the LED threshold increases due to aging.

Figure 2:
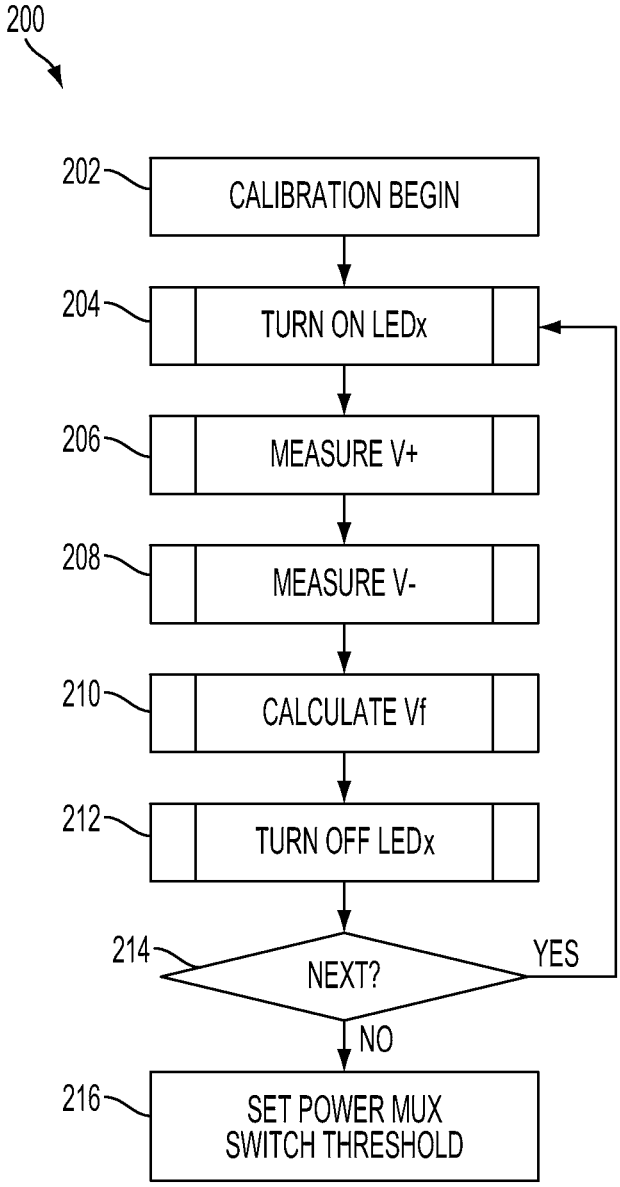
FIG. 2 is a flow diagram of a method of LED forward voltage measurement for optimum system efficiency according to an embodiment.

FIG. 2 illustrates the steps in the method. The method, 200 starts with the beginning of calibration in step 202. In step 204 the LED, such as 124*a*, is turned on. In step 206 the anode voltage, V+, is measured. In step 208, the cathode voltage, V−, is measured. These values are input to the forward voltage measurement algorithm and the forward voltage is calculated in step 210. In step 212 one or more LEDs is turned off. The method checks to see if there are additional LEDs requiring a forward voltage calculation in step 214. If there are additional LEDs to be handled, the method returns to step 204 and the next LED, such as 124*b*, is turned on and the method is repeated for that LED. If there are no additional LEDs requiring forward voltage calculations, there method proceeds to step 216. In step 216 the power multiplexer threshold is set. Once the power multiplexer threshold is set, the method ends.

Further embodiments of the method provide periodic scanning that may be based on temperature changes. In addition, the method may be performed on demand, as well as during power up of the mobile device.

It is understood that the specific order or hierarchy of steps in the processes disclosed is an illustration of exemplary approaches. Based upon design preferences, it is understood that the specific order or hierarchy of steps in the processes may be rearranged. The accompanying method claims present elements of the various steps in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

What is claimed is:

1. A method for optimizing operating efficiency for a light emitting diode (LED) comprising:
- turning on at least one LED; and
- measuring an anode voltage of the at least one LED;
- measuring a cathode voltage of the at least one LED;
- calculating a forward voltage of the at least one LED;
- turning off the at least one LED; and
- setting a power multiplexer select threshold based on the measured anode and cathode voltages; and
- switching from a battery to a boost power supply when the forward voltage of the at least one LED is less than a total of a LED maximum voltage and a desired voltage headroom.

2. The method of claim 1, where a second LED has a different threshold set from the at least one LED.

3. The method of claim 1, wherein a different voltage is applied to each LED.

4. The method of claim 1, wherein the power multiplexer select threshold is set to be minimally above a forward dropout voltage.

5. The method of claim 1, wherein calculating the forward voltage of the at least one LED occurs on power up of a mobile device.

6. The method of claim 1, wherein the forward voltage of the at least one LED is increased to compensate for loss of brightness due to aging of the LED.

7. The method of claim 1, further comprising: periodically scanning the at least one LED based on temperature changes.

8. An apparatus for, of optimizing efficiency for a light emitting diode (LED) operation range comprising:
- means for turning on at least one LED;
- means for measuring an anode voltage of the at least one LED;
- means for measuring a cathode voltage of the at least one LED;
- means for calculating a forward voltage of the at least one LED;
- means for turning off the at least one LED; and
- means for setting a power multiplexer switch threshold based on the measured anode and cathode voltages; and
- means for switching from a battery to a boost power supply when the forward voltage of the at least one LED is less than a total of a LED maximum voltage and a desired voltage headroom.

9. The apparatus of claim 8, further comprising means for setting a second LED to a different threshold from the least one LED.

10. The apparatus of claim 8, further comprising means for applying a different voltage to each LED.

11. The apparatus of claim 8, further comprising means for setting a power multiplexer switch threshold minimally above a forward dropout voltage.

12. The apparatus of claim 8, further comprising means for calculating the forward voltage of the at least one LED on power up of a mobile device.

13. The apparatus of claim 8, further comprising means for increasing the forward voltage of the at least one LED to compensate for loss of brightness due to aging of the LED.

14. The apparatus of claim 8, further comprising means for periodically scanning the at least one LED based on temperature changes.

15. A non-transitory computer readable medium containing instructions for optimizing light emitting diode (LED) operation range, which when executed by a processor, cause the processor to perform the steps of:
- turning on at least one LED;
- measuring an anode voltage of the at least one LED;
- measuring a cathode voltage of the at least one LED;
- calculating forward voltage of the at least one LED;
- turning off the at least one LED; and
- setting a power switch multiplexer select threshold based on the measured anode and cathode voltages; and
- switching from a battery to a boost power supply when the forward voltage of the at least one LED is less than a total of a LED maximum voltage and a desired voltage headroom.

16. The non-transitory computer readable medium of claim 15 further comprising:
- instructions for setting a threshold for a second LED that is different from the threshold set for the at least one LED.

17. The non-transitory computer readable medium of claim 15, further comprising: instructions for applying a different voltage to each LED.

18. The non-transitory computer readable medium of claim 15 further comprising: instructions for setting a threshold of a power switch multiplexer.

19. The non-transitory computer readable medium of claim 15 further comprising:
- instructions for calculating the forward voltage of the at least one LED on power up of a mobile device.

20. The non-transitory computer readable medium of claim 15 further comprising:
- instructions for increasing the forward voltage of the at least one LED to compensate for loss of brightness due to aging of the at least one LED.

21. The non-transitory computer readable medium of claim 15 further comprising:
- instructions for periodically scanning the at least one LED based on temperature changes.

* * * * *